US012385719B2

(12) United States Patent
Teetzel et al.

(10) Patent No.: US 12,385,719 B2
(45) Date of Patent: Aug. 12, 2025

(54) WEAPON SLING WITH INTEGRAL CONNECTORS FOR WIRED COMMUNICATION AND/OR POWER TRANSFER

(71) Applicant: WILCOX INDUSTRIES CORP., Newington, NH (US)

(72) Inventors: James W. Teetzel, Portsmouth, NH (US); Elliott S. Turner, Newmarket, NH (US)

(73) Assignee: Wilcox Industries Corp., Newington, NH (US)

( * ) Notice: Subject to any disclaimer, the term of this patent is extended or adjusted under 35 U.S.C. 154(b) by 113 days.

(21) Appl. No.: 18/423,698

(22) Filed: Jan. 26, 2024

(65) Prior Publication Data

US 2024/0384968 A1 Nov. 21, 2024

Related U.S. Application Data

(60) Provisional application No. 63/444,302, filed on Feb. 9, 2023.

(51) Int. Cl.
*F41C 33/00* (2006.01)
*F41C 27/00* (2006.01)

(52) U.S. Cl.
CPC ..... *F41C 33/002* (2013.01); *F41C 27/00* (2013.01)

(58) Field of Classification Search
CPC ..... F41C 33/00; F41C 33/002; F41C 33/001; F41C 23/02; F41C 27/00; F41C 33/005; A41D 13/0012; A41D 1/002; A45F 2005/006; A45F 5/00; A45F 2003/142; A45F 3/14; A45F 5/1533; Y10S 224/902; Y10S 224/93
See application file for complete search history.

(56) References Cited

U.S. PATENT DOCUMENTS

| | | | | |
|---|---|---|---|---|
| 5,211,321 | A * | 5/1993 | Rodriguez | A45F 5/00 224/604 |
| 11,168,956 | B2 * | 11/2021 | Dilling | F41C 33/002 |
| 2019/0033035 | A1 * | 1/2019 | Echevarria | F41C 33/002 |
| 2020/0278174 | A1 * | 9/2020 | Gill | F41H 1/02 |
| 2024/0164464 | A1 | 5/2024 | Teetzel et al. | |
| 2024/0255257 | A1 | 8/2024 | Teetzel et al. | |

* cited by examiner

*Primary Examiner* — Corey N Skurdal
(74) *Attorney, Agent, or Firm* — McLane Middleton, Professional Association

(57) ABSTRACT

A weapon sling includes a strap having first and second free ends and defining a main branch between the first and second free ends. The strap member is formed of an elongate hollow flexible, e.g., textile, element. A loop branch attached to the main branch is configured to be looped around a user's body. First and second connector assemblies are secured to the respective first and second free ends. The first connector assembly is for detachable coupling to a weapon connector on the weapon. The second connector assembly is for detachable coupling to a hub connector on a hub worn by the user. A plurality of electrical conductors extend within the elongate hollow flexible element for electrically coupling electrical contacts on the first connector assembly with electrical contacts on the second connector assembly for providing communications between a host computer on the weapon and the hub.

19 Claims, 16 Drawing Sheets

WEAPON SLING WITH INTEGRAL CONNECTORS FOR WIRED COMMUNICATION AND/OR POWER TRANSFER

CROSS REFERENCE TO RELATED APPLICATION

This application claims the priority benefit of U.S. provisional application No. 63/444,302 filed Feb. 9, 2023. The aforementioned application is incorporated herein by reference in its entirety.

BACKGROUND

The present invention relates to generally to weapon slings and, in particular, to weapon slings having integrated electrical conductors for communication of power, control, and/or data signals between a computer-based information handling system on a weapon and a power, control, and/or data hub worn on the body of a user.

Weapon slings are used with weapons, such as rifles, grenade launchers, rocket launchers, or the like. Typically, such slings are used to retain or secure the weapon to the user, allow the user to carry the weapon in a hands free manner, support the weapon while shooting, etc.

Weapons commonly include an accessory rail having electronics mounted to the rail or within the rail. Exemplary electronics include laser sights and illuminators, range finders, fire control systems, night vision devices, thermal and other cameras, flashlights, displays, computer systems, and so forth. Such electronic devices may require power from an external power supply. Such electronic devices may also send and/or receive data and/or control signals.

Other electronic devices may be attached to other wearable articles, such as a helmet and others. However, connecting electronics on the weapon with other electronics disposed on a helmet or other article worn by the user has proven difficult. Cable connections extending between a weapon and the user have a tendency to snag and are easily damaged. Therefore, a need remains for a robust communication connector system for a weapon that readily interconnects electronic accessory components on a weapon with electronic accessory components worn elsewhere on the body of the user.

The present disclosure contemplates a new and improved weapon sling which addresses the above-referenced problems and others.

SUMMARY

In one aspect, a weapon sling for supporting a weapon comprises a strap member having a first free end and a second free end opposite the first free end and defining a main branch extending between the first free end and the second free end, the strap member being formed of an elongate hollow flexible element. A loop branch is attached to the main branch, the loop branch being configured to be looped around at least a portion of a body of a user. A first connector assembly is secured to the first free end and a second connector assembly secured to the second free end. The first connector assembly is configured for detachable coupling to a weapon connector disposed on the weapon. The second connector assembly is configured for detachable coupling to a hub connector disposed on a hub worn on the body of the user. A plurality of electrical conductors extend within the hollow flexible element for electrically coupling a plurality of electrical contacts on the first connector assembly with a corresponding plurality of electrical contacts on the second connector assembly, the plurality of electrical conductors for providing communications between a host computer on the weapon and the hub.

In a more limited aspect, the loop branch has a first fixed end attached to the main branch proximal the first free end of the main branch and a second fixed end attached to the main branch proximal the second free end of the main branch.

In another more limited aspect, the loop branch has a first fixed end attached to the main branch proximal the first free end of the main branch and a third free end configured to be detachably coupled to the weapon.

In another more limited aspect, the first connector assembly includes a locking mechanism configured to provide a locking engagement between the first connector assembly and the weapon connector.

In another more limited aspect, the first connector assembly includes a breakaway mechanism configured to disengage the first connector assembly from the weapon connector when a pulling force on the first connector assembly exceeds a preselected threshold. In another more limited aspect, the breakaway mechanism comprises at least one ball detent captured within a receptacle on the first connector assembly, the at least one ball detent configured to mate with at least one recess within the weapon connector.

In another more limited aspect, the second connector assembly includes a breakaway mechanism configured to disengage the second connector assembly from the hub connector when a pulling force on the second connector assembly exceeds a preselected threshold. In another more limited aspect, the breakaway mechanism comprises at least one ball detent captured within a receptacle on the second connector assembly, the at least one ball detent configured to mate with at least one recess within the hub connector.

In another more limited aspect, the strap member is formed of an elongate hollow textile element.

In another more limited aspect, at least a portion of the elongate hollow textile element is stretchable.

In another more limited aspect, at least a portion of the plurality of electrical conductors is folded back on itself for accommodating stretching while maintaining an electrical connection.

In another more limited aspect, at least a portion of the elongate hollow textile element is formed of a nylon webbing material.

In another more limited aspect, the second connector assembly comprises a Universal Serial Bus (USB) connector.

In another more limited aspect, the weapon is provided in combination with the hub.

In another more limited aspect, the hub comprises a housing adapted to be attached to be a garment.

In another more limited aspect, the hub comprises a sleeve attached to the housing, wherein the sleeve is adapted to be adapted to be attached to be the garment.

In another more limited aspect, the sleeve is configured to be detachably attached to a shoulder strap of the garment.

In another more limited aspect, the sleeve is configured to be selectively attached to a left shoulder strap and a right shoulder strap of the garment.

In another more limited aspect, the garment is a vest selected from the group consisting of a plate carrier vest, tactical vest, load bearing or load carrying vest.

Advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
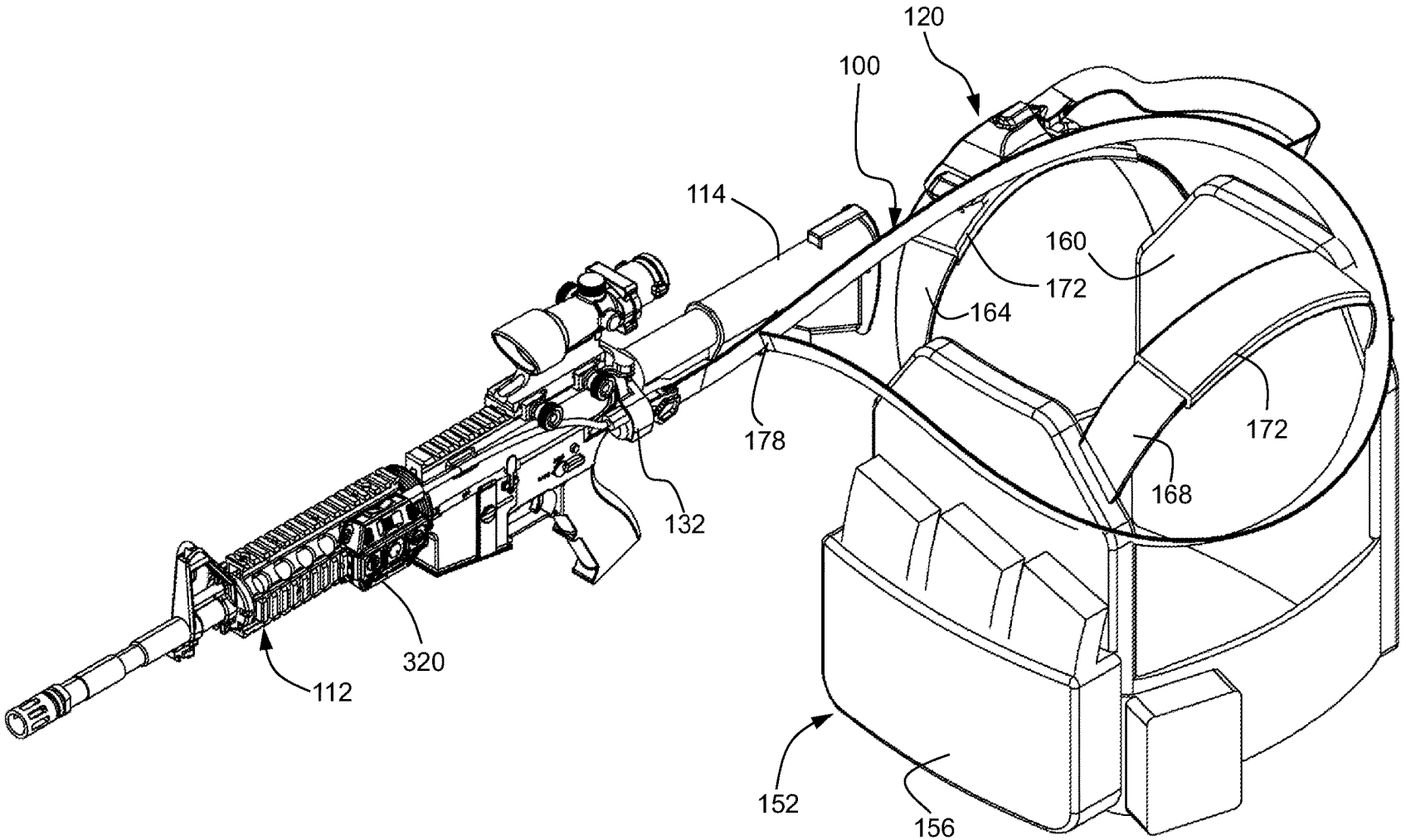
FIG. 1 is an isometric view of a weapon interconnected with an associated plate carrier vest using a weapon sling in accordance with a first exemplary embodiment, taken generally from the front and left side. The first embodiment weapon sling assembly defines a single point sling in that it has one point of attachment to the weapon.
Figure 2:
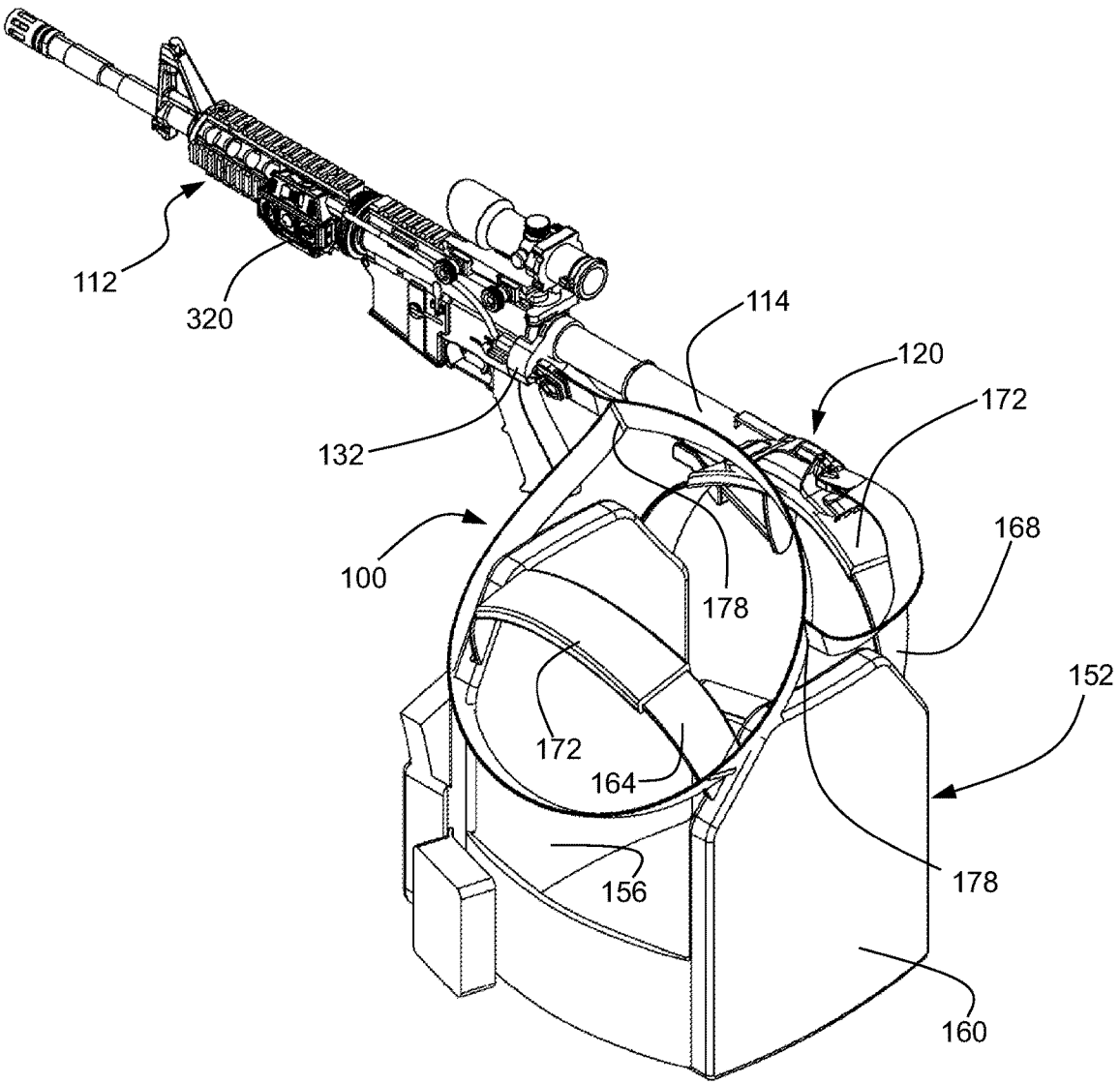
FIG. 2 is an isometric view of a weapon interconnected with an associated plate carrier vest using a weapon sling in accordance with the first exemplary embodiment, taken generally from the rear and left side.
Figure 3:
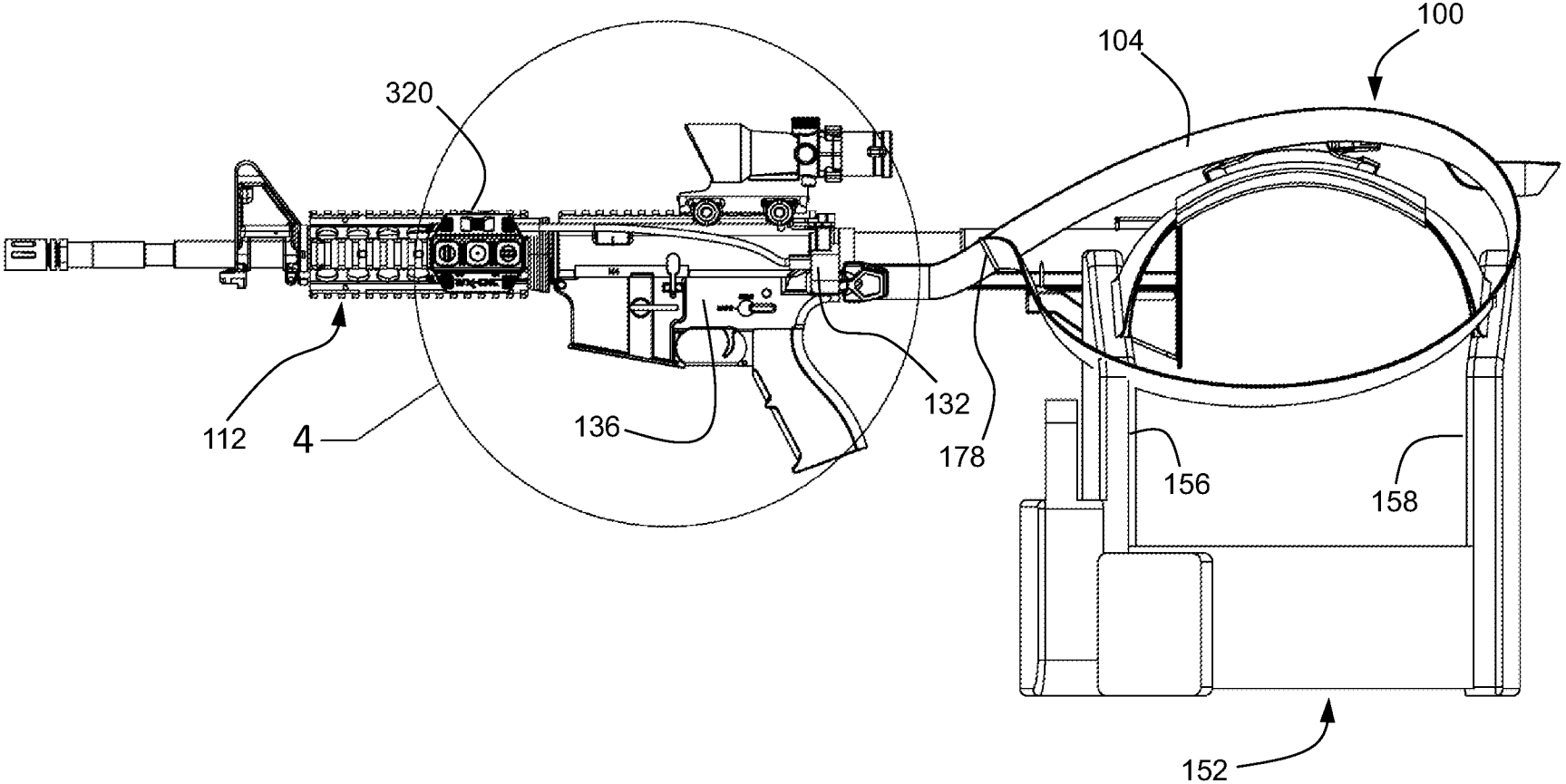
FIG. 3 is left side view of a weapon interconnected with an associated plate carrier vest using a weapon sling in accordance with the first exemplary embodiment.
Figure 4:
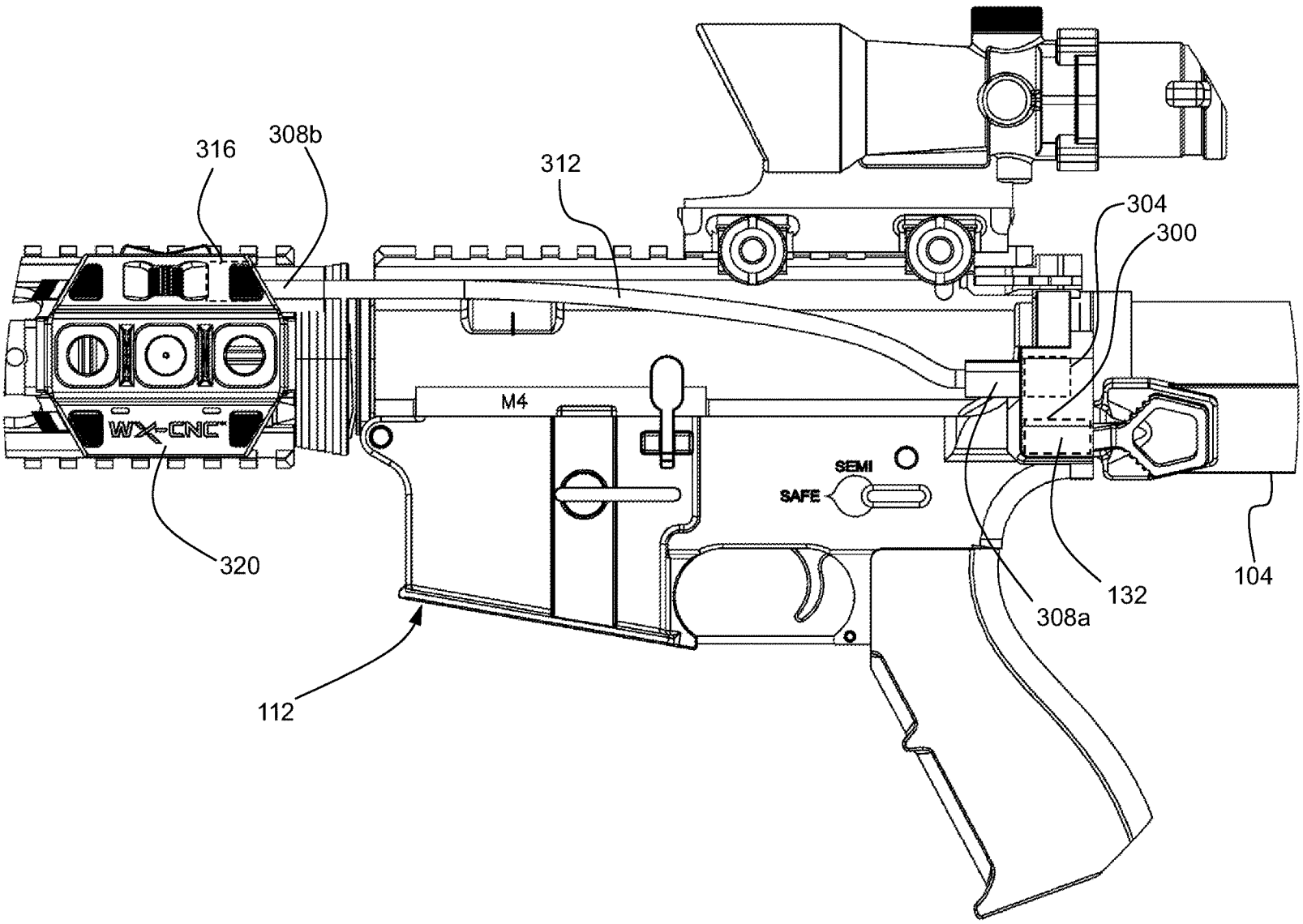
FIG. 4 is an enlarged view of the region 4 appearing in FIG. 3.
Figure 5:
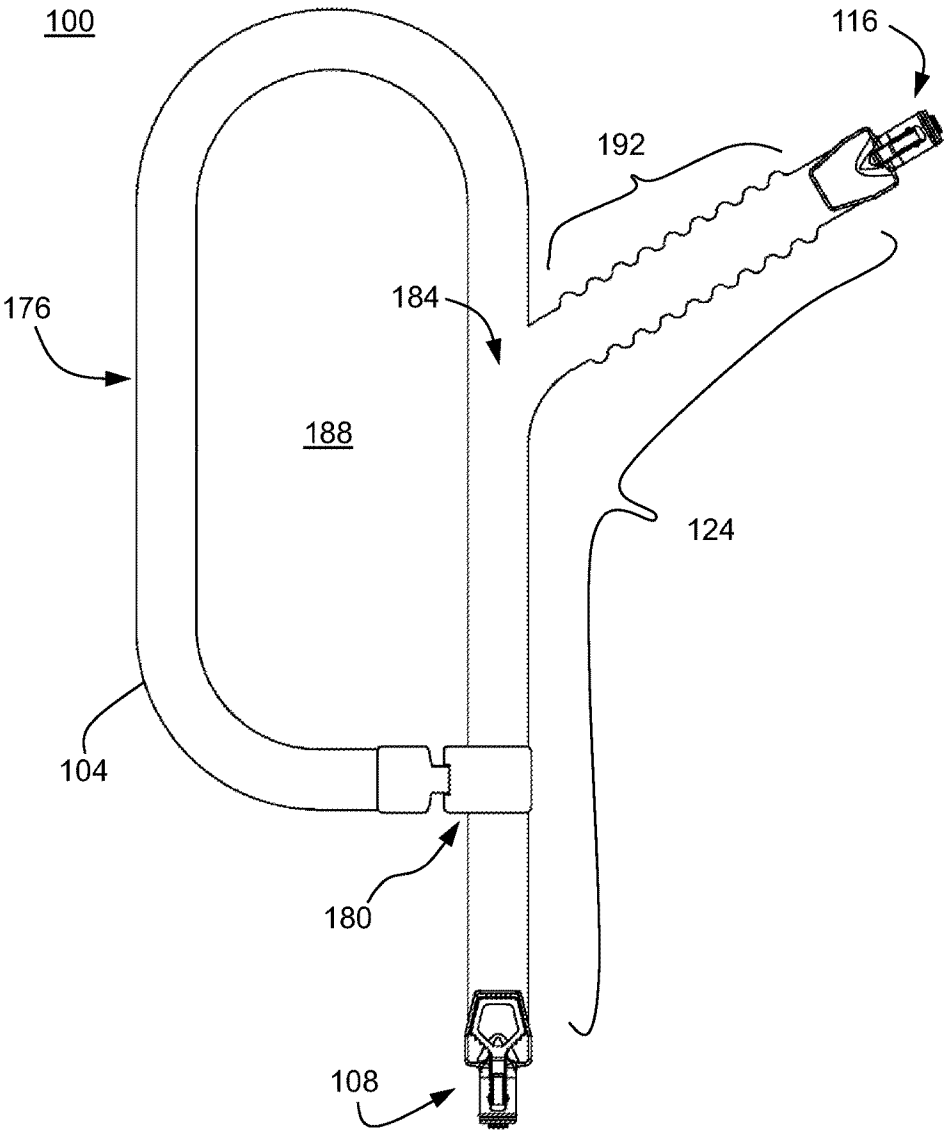
FIG. 5 is a plan view of the first embodiment weapon sling appearing in FIG. 1.

Reference will now be made in detail to presently preferred embodiments of the invention, one or more examples of which are illustrated in the accompanying drawings. Each example is provided by way of explanation of the invention, not limitation of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Unless specified otherwise, the term "proximal" as used herein, e.g., concerning the relative position of a fixed end or attachment point in relation to a free end, is not limited to direct adjacency and it does not exclude the possibility of there being a measurable distance between the fixed end or attachment point and the free end. Rather, unless specified otherwise, the term "proximal" is intended to signify the absence of intervening fixed ends or attachment points disposed between the specified fixed end or attachment point and the referenced free end.

Referring now to the drawings, FIGS. 1-5 and 7 illustrate a weapon sling assembly 100 in accordance with a first exemplary embodiment. The weapon sling assembly 100 comprises an elongate hollow flexible element 104 defining a strapping element, which is preferably a hollow textile element 104. In embodiments, the hollow textile element 104 is formed of a flexible textile material. In embodiments, the elongate hollow textile element 104 is formed of a tubular braided material, tubular woven material, tubular knot material, or the like. In embodiments, the elongate hollow textile element 104 is formed from a folded web that is secured along a longitudinal seam, such as via stitching, adhesive, heat sealing, zipper, clasps, or other fastener(s). In certain embodiments, the elongate hollow textile element 104 is formed of a natural or synthetic textile material. In certain embodiments, the elongate hollow textile element 104 is formed of a hollow nylon webbing material.

The elongate hollow textile element 104 comprises a first free end 108 configured for detachable attachment to a weapon 112 and a second free end 116 configured for detachable attachment to a hub 120 intended to be wearable by a user. The elongate hollow textile element 104 includes a main branch 124 which extends between the first free end 108 and the second free end 116. The hub 120 is preferably a Universal Serial Bus (USB) hub, although other hub protocols are contemplated, including IEEE 1394 and others.

The first free end 108 terminates in a weapon connector assembly 128 which detachably engages a complementary connector element 132 disposed on a receiver 136 of the weapon 112. The second free end 116 terminates in a hub connector assembly 140 which detachably engages a complementary connector element 144 on the hub 120 which is adapted to be worn on the body of the user. In the depicted embodiment, the hub 120 includes a housing 148 configured to be attached to a garment 152 or other wearable element worn by the user.

In the illustrated preferred embodiment, the garment 152 is a vest, such as plate carrier vest, tactical vest, load bearing or load carrying vest, or the like. In embodiments, the garment 152 has front and rear panels 156, 160, respectively, which are adjoined by left and right shoulder straps 164, 168, respectively. In embodiments, the hub housing 148 is attached to a sleeve 172 slidably receiving the right shoulder strap 168 to allow positioning the hub 120 on the right shoulder of the user. Positioning the hub 120 on the left shoulder strap 164 to accommodate a left-handed shooter is also contemplated.

The elongate hollow textile element 104 further includes a loop branch 176. The loop branch 176 has a first end 180 which diverges from the main branch 124 proximal the first free end 108 and a second end 184 which diverges from the main branch 124 proximal the second free end 116 to form a loop 188. In embodiments, the junctions 180, 184 between the main branch 124 and the loop branch 176 may be secured by stitching 178. The loop branch 176 is secured to the main branch 124 to form a loop which passes over the right shoulder and under the user's left arm. In the illustrated embodiment, the loop branch 176 is secured to the main branch 124 to form a continuous loop. In alternative embodiments, the loop branch 176 may have free ends which are attachable together using fastener elements buckles or clasps (not shown) as would be understood by persons skilled in the art. In such alternative embodiments, such fastener elements may have adjustment features to adjust the size of the loop 188, as would be understood by persons skilled in the art.

A portion of the elongate hollow textile element 104 main branch 124 between the junction 184 and the second free end 116 has a section 192 formed of an elastic or resiliently stretchable material to provide freedom of movement of the user without excess slack. Any electrical conductors, as described below, within the stretchable portion 192 of the main branch 124 may have portions that are folded back upon themselves within the sleeve 104 to accommodate stretching of the sleeve stretchable portion 192. In certain embodiments, the stretchable portion 192 is able to stretch, e.g., from approximately 20% to 100% beyond its original, unstretched length.

Figure 6:
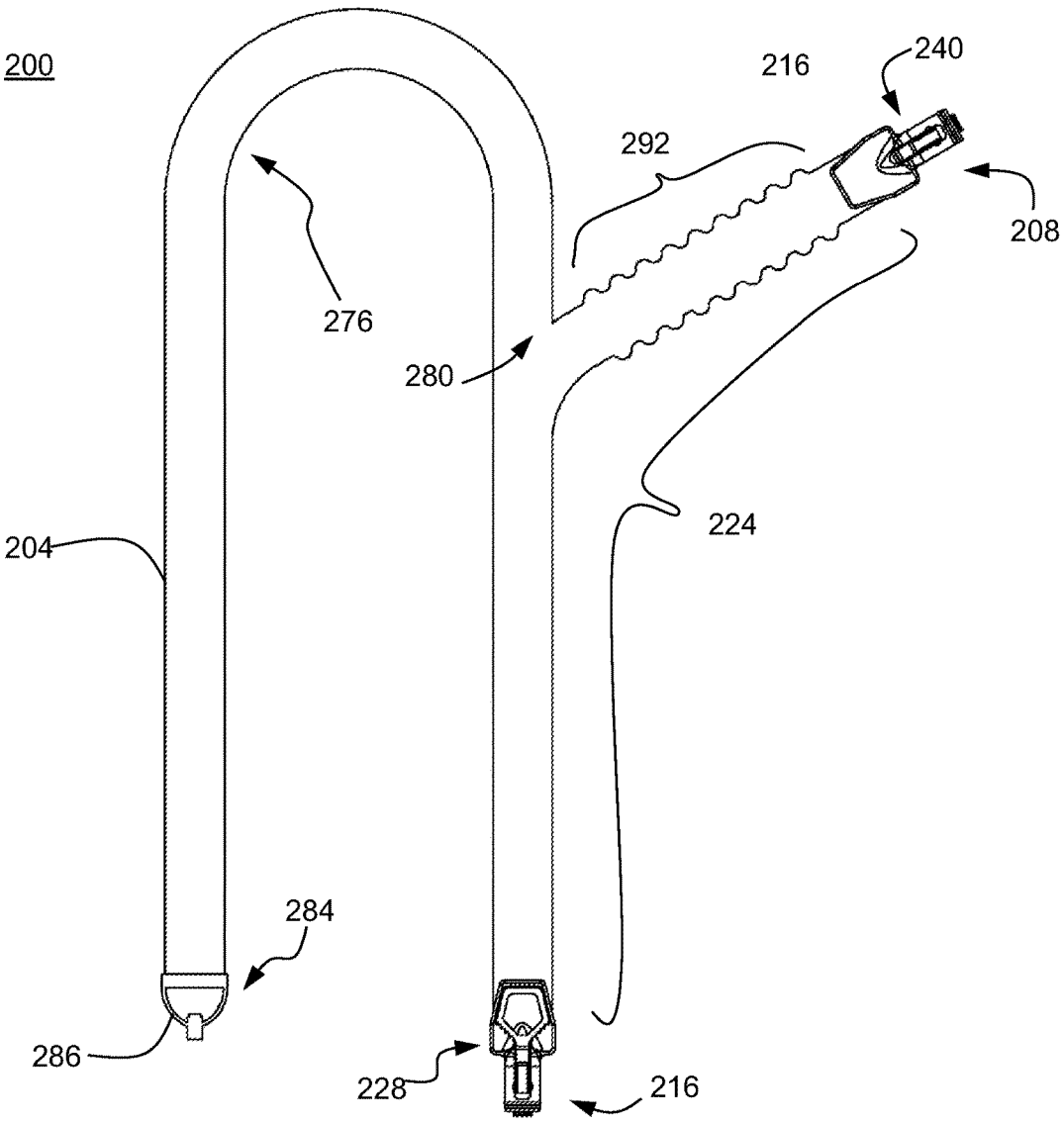
FIG. 6 is a plan view of a second embodiment weapon sling. The second embodiment weapon sling assembly defines a two point sling in that it has two points of attachment to the weapon.

Referring now to FIG. 6, there is shown a weapon sling assembly 200 in accordance with a second exemplary embodiment. The weapon sling assembly 200 comprises an elongate hollow textile element 204 defining a strapping element. The hollow textile element 204 may be formed of the materials as described above with respect to the elongate hollow textile element 104.

The elongate hollow textile element 204 comprises a first free end 208 configured for detachable attachment to the weapon 112 and a second free end 216 configured for detachable attachment to the hub 120. The elongate hollow textile element 204 includes a main branch 224 which extends between the first free end 208 and the second free end 216.

The first free end 208 terminates in a weapon connector assembly 228 which detachably engages the complementary connector element 132 disposed on a receiver 136 of the weapon 112. The second free end 216 terminates in a hub connector assembly 240 which detachably engages the complementary connector element 144 on the hub 120.

The elongate hollow textile element 204 further includes a loop branch 276. The loop branch 276 has a first end 280 which diverges from the main branch 224 intermediate the first and second free ends 208, 216. The loop branch 276 has a second, free end 284 having a fastener element 286 for detachably attaching the free end 284 a complementary fastener element (not shown) on the weapon 112. In embodiments, the complementary fastener element (not shown) is disposed on a buttstock portion 114 of the weapon. In embodiments, the fastener element 286 is a quick disconnect (QD) sling swivel as are generally known in the art.

The junction 280 between the main branch 224 and the loop branch 276 may be secured by stitching. In the illustrated embodiment, the loop branch 276 is of fixed length. In alternative embodiments, the loop branch 276 may further include an adjustment mechanism, such as a slide buckle or similar strap adjuster as would be understood by persons skilled in the art to adjust the length of the loop branch 276.

A portion of the elongate hollow textile element 204 main branch 224 between the junction 284 and the second free end 216 has a section 292 formed of an elastic or resiliently stretchable material to provide freedom of movement of the user without excess slack. Any electrical conductors within the stretchable portion 292 of the main branch 224 may have portions that are folded back upon themselves within the sleeve 204 to accommodate stretching of the sleeve 204.

Figure 7:
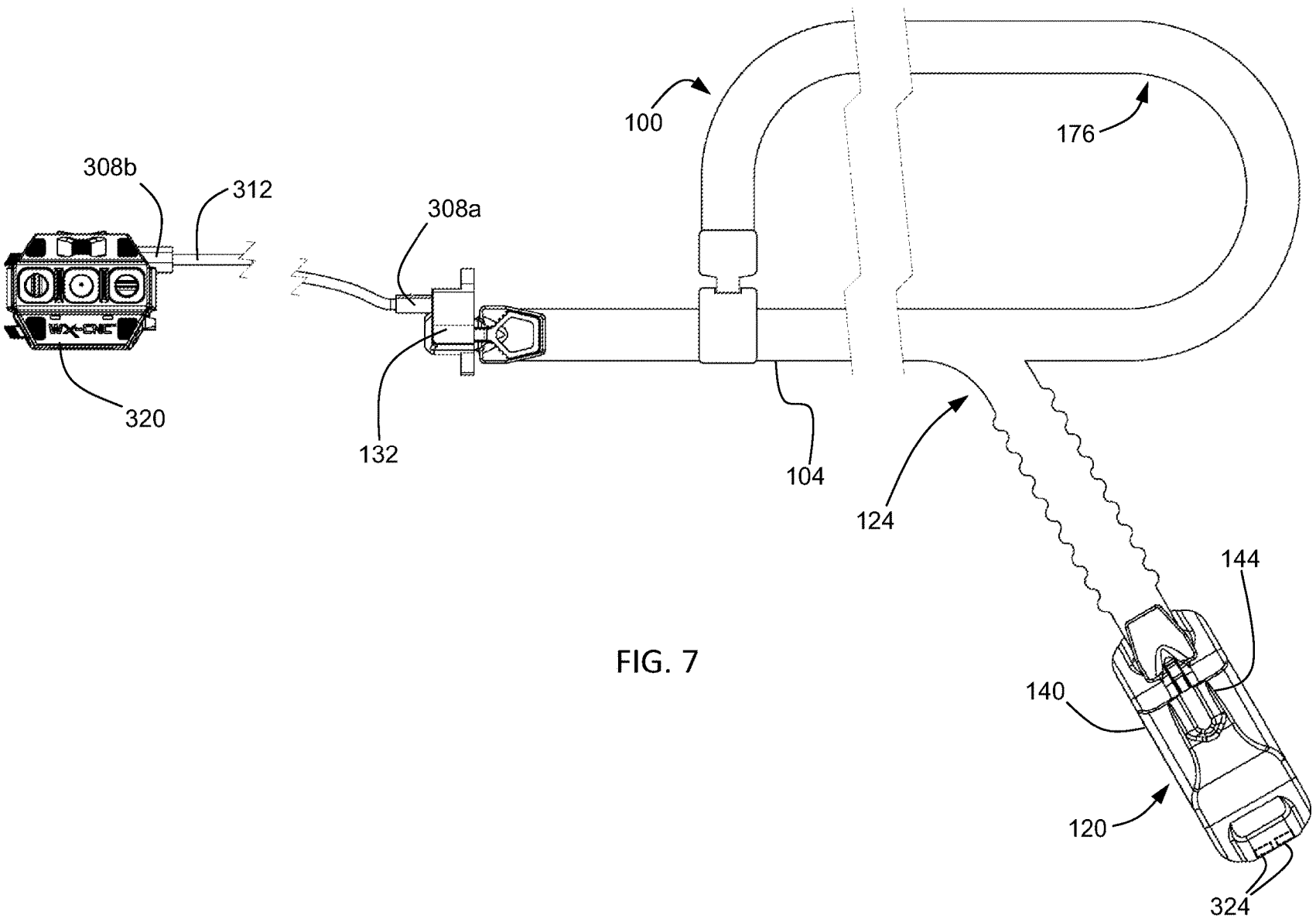
FIG. 7 is a plan view of the first embodiment weapon sling having a first end coupled to a connector on the weapon and a second end coupled to an electrical connector on the associated plate carrier vest.

As best seen in FIG. 7, the weapon connector assembly 132 includes a first receptacle 300 for receiving the first connector end 128 and a second receptacle 304 for receiving a first connector end 308*a* of a cable 312. In the illustrated embodiment, the cable 312 is a USB Type-C cable. A second connector end 308*b* of the cable 312 is connected to connection port 316 of a host computer system 320, e.g., disposed on the weapon 112. The computer system 320 is configured to function as a central controller for integrating multiple accessory devices associated with the weapon 112 and/or the user. In certain embodiments, the computer system 320 is a central network controller as described in commonly-owned U.S. Patent Application Nos. 63/423,324 filed Nov. 7, 2022, and Ser. No. 18/381,937 filed Oct. 19, 2023, each entitled "Central Network Controller for Weapon Accessory Devices," wherein the entire contents of each of the aforementioned applications, including the drawings, are incorporated herein by reference in their entireties. In certain embodiments, the connection ports 300 are locking USB Type-C connection ports as shown and described in the aforementioned U.S. Patent Application No. 63/423,324 and Ser. No. 18/381,937.

Figure 8:
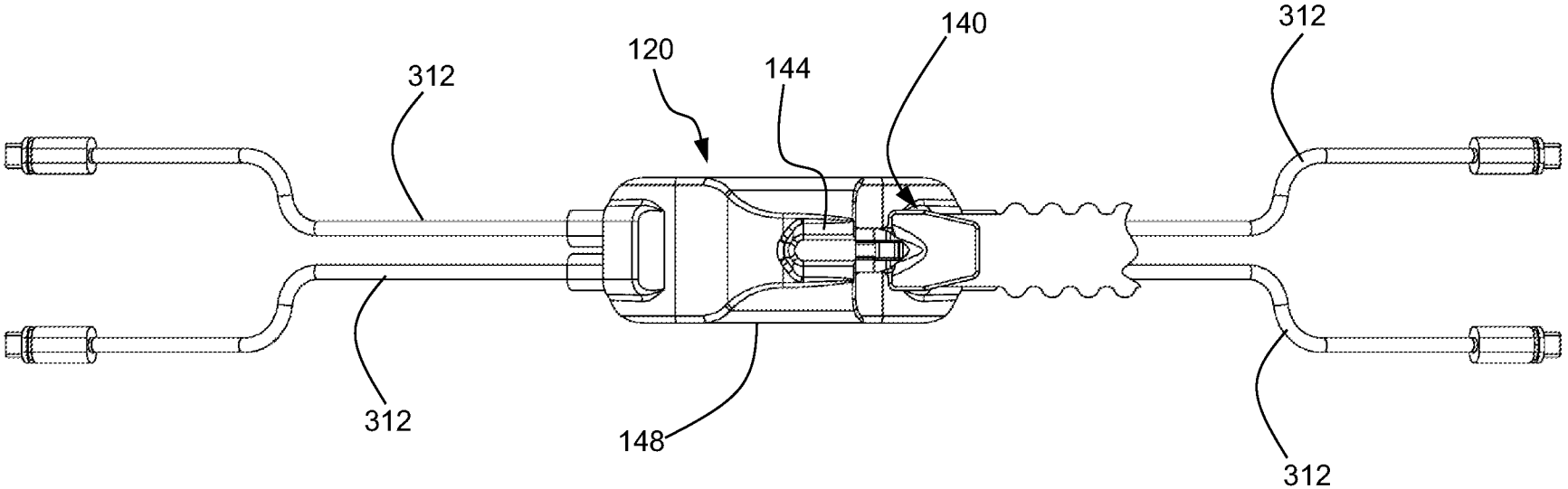
FIG. 8 is a plan view of the electrical connector on the associated plate carrier vest.

Referring now to FIG. 8, and with continued reference to FIGS. 1-7, the hub 120 includes a plurality of connection ports 324 configured to receive a first connection end 308*a* of a complementary cable 312. In the illustrated embodiment, the hub 120 has four USB Type-C connection ports 324, although other numbers of ports and hub protocols are contemplated. In certain embodiments, the connection ports 324 are locking USB Type-C connection ports as shown and described in the aforementioned U.S. Patent Application No. 63/423,324 and Ser. No. 18/381,937.

Figure 9:
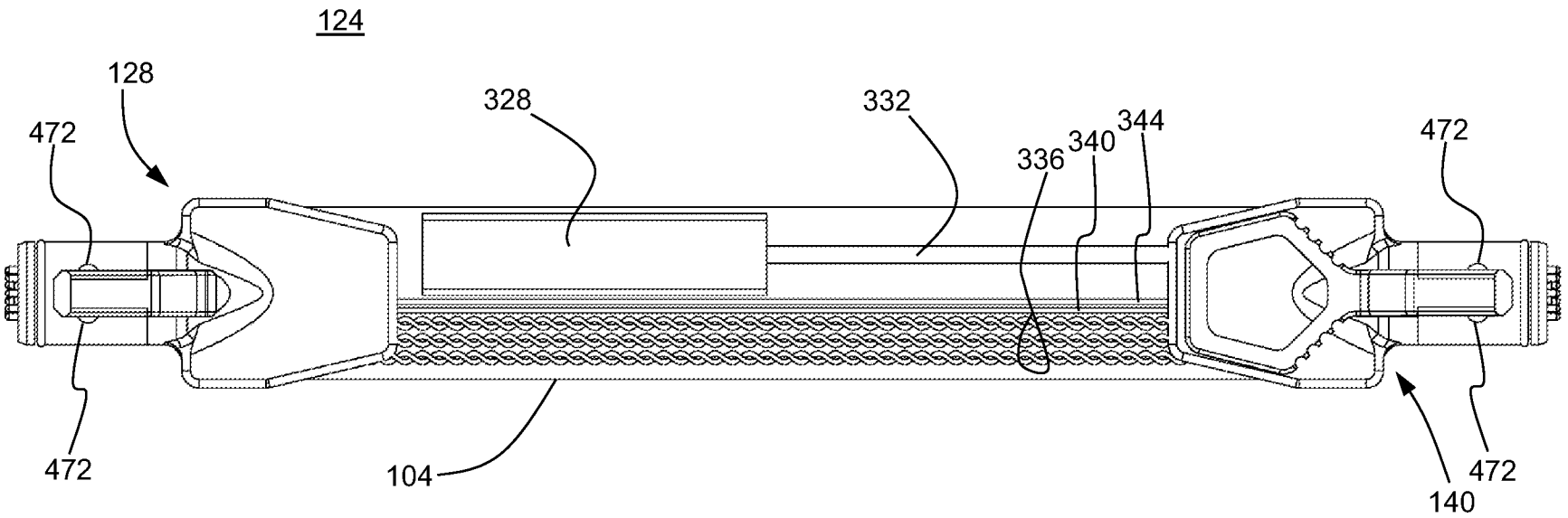
FIG. 9 is a plan view of the cable carrying portion of the weapon sling with the outer cover removed for illustration purposes.

Referring now to FIG. 9, and with continued reference to FIGS. 1-8, there is illustrated the main branch 124 extending between the first free end 108 and the second free end 116 having one side of the elongate hollow textile element 104 removed for illustration purposes. The description below is equally applicable to the main branch 224 of the sling assembly 200.

The main branch 124 includes a wide band antenna 328 which is electrically coupled to a wireless interface (RF transceiver) of the computer system 320 via a coaxial cable 332. The internal cabling within the elongate hollow textile element 104 further includes three twisted conductors pairs 336 for data transfer, and power and ground conductors 340, 344, respectively, for power transfer.

Figure 10:
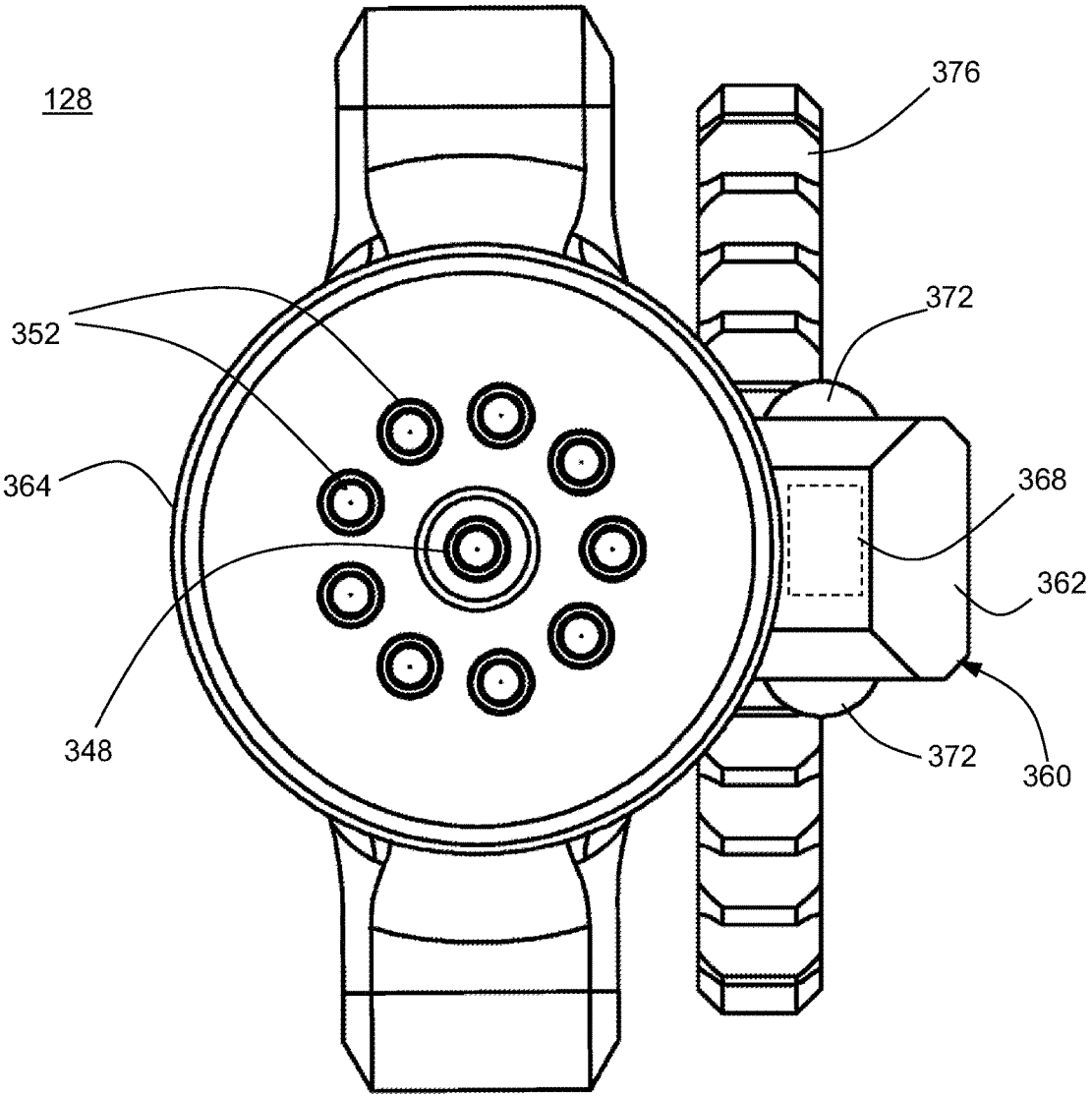
FIG. 10 is an end view of the weapon sling connector end for attaching to the weapon.
Figure 11:
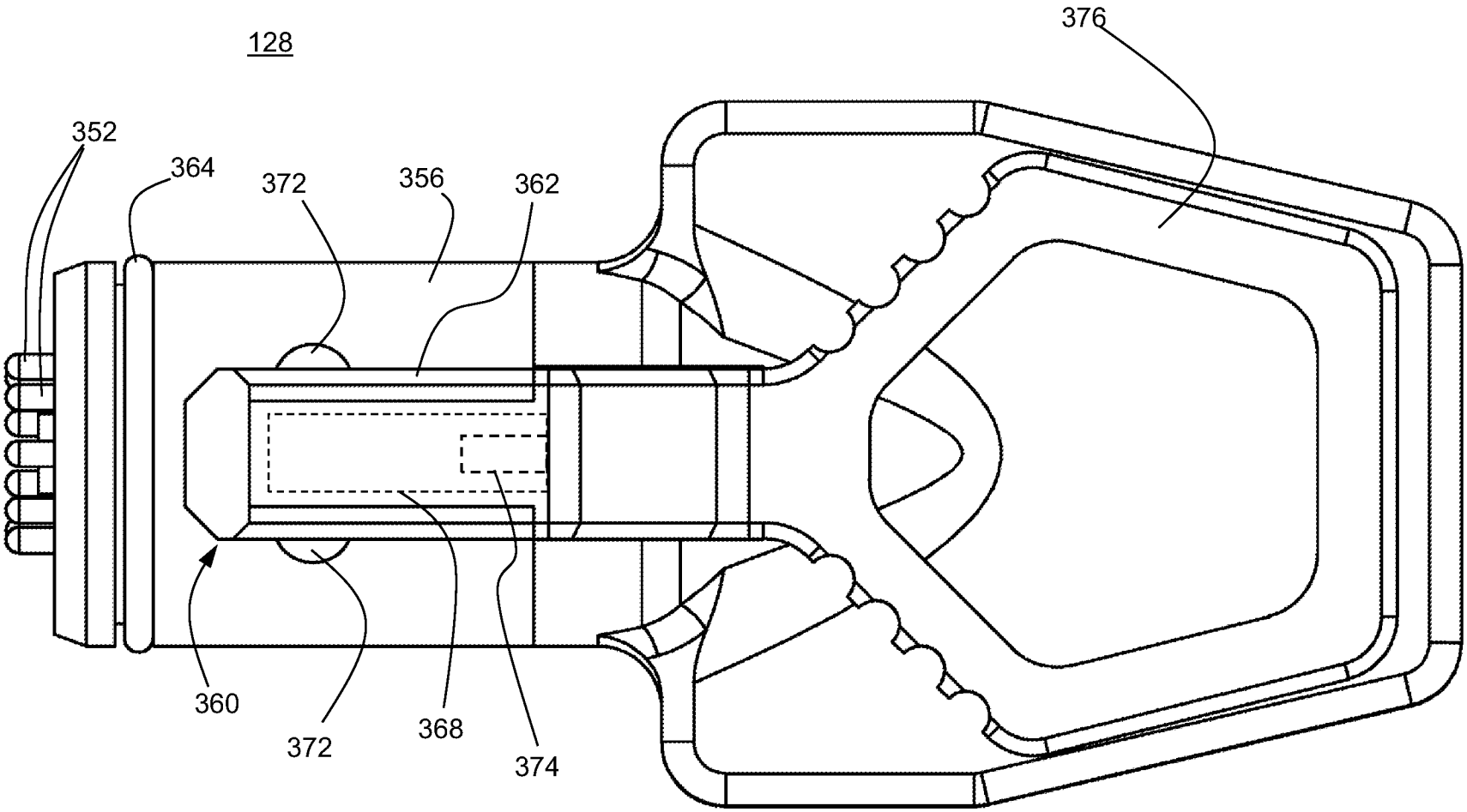
FIG. 11 is a side view of the weapon sling connector end appearing in FIG. 10.
Figure 12:
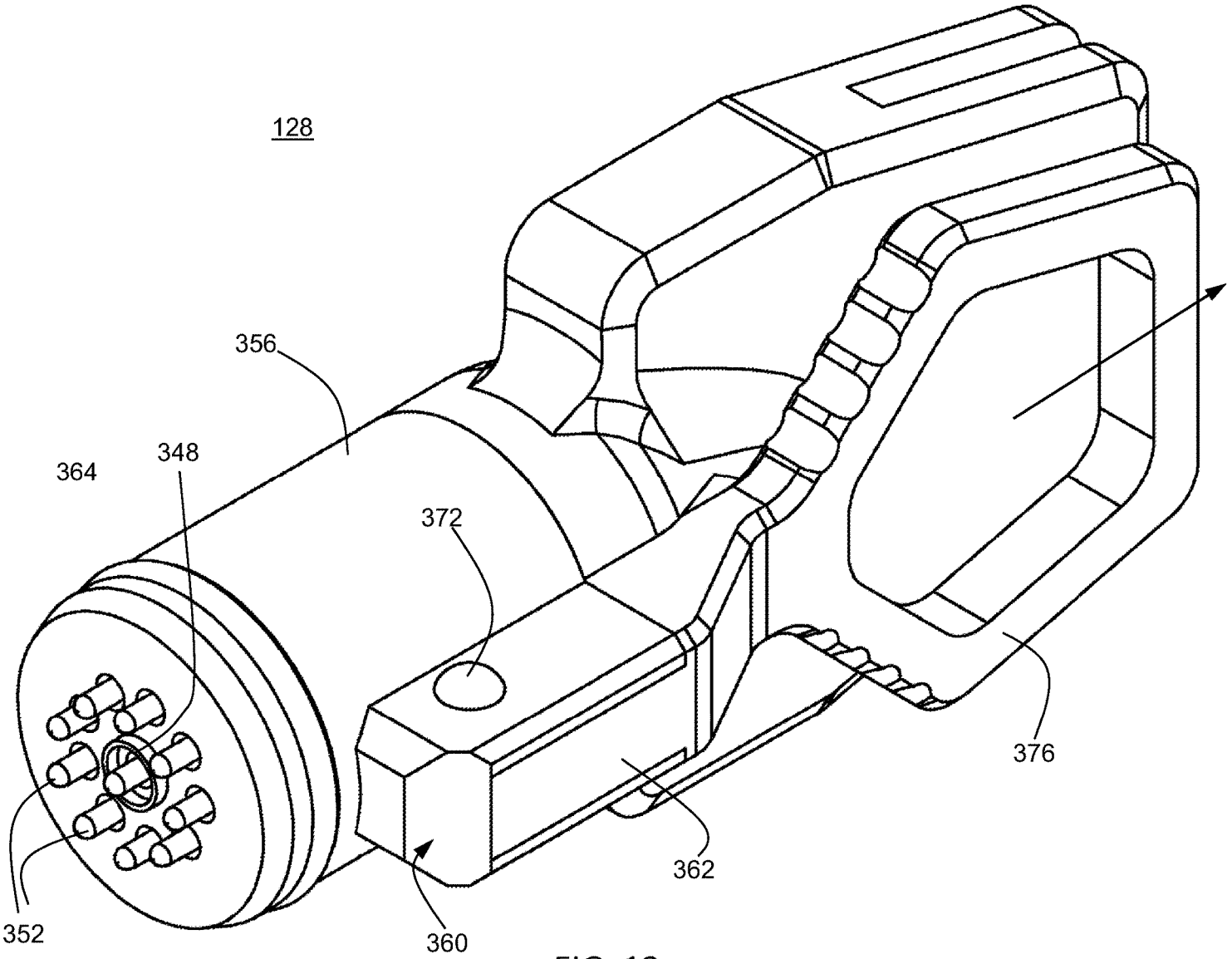
FIG. 12 is an isometric view of the weapon sling connector end appearing in FIG. 10.

Referring now to FIGS. 10-12, and with continued reference to FIGS. 1-9, the connector 128 includes a coaxial connector 348 which is electrically coupled to the coaxial cable 332. A plurality of connector pins 352 (nine in the illustrated embodiment) align with complementary connector terminals or pads (not shown) disposed within the weapon connector receptacle 300 on the weapon connector assembly 132. Each connector pin 352 is electrically coupled to a corresponding conductor within the main branch 124, including the twisted pair conductors, power, and ground conductors. One or more of the pins 352 may also be coupled to a drain wire, metallic or conductive shield, e.g., for carrying unwanted electrical noise to ground. In embodiments, the connector pins 352 are spring-loaded telescoping (pogo) pins.

The connector assembly 128 includes a cylindrical body 356 with an axially extending projection 360. A sealing ring 364 prevents entry of moisture or other external contamination. The projection 360 aligns with a complementary axial channel in the receptacle 300 of the connector assembly 132 and provides a keyed configuration to ensure proper alignment of the connector 128 within the receptacle 300.

A ball detent locking feature allows for locking retention of the connector 128 within the receptacle 300. The projection 360 defines a housing 362 enclosing an axially-extending channel which slidably receives a retractable plunger 368. Captured ball members 372 extend through the projection housing 360 and are aligned with and engage complementary recesses or depressions within the receptacle 300 when the connector 128 is locked within the receptacle 300.

A pull tab 376 is coupled to the plunger 368 to allow manual axial sliding movement of the plunger 368 within the housing 362. When the plunger 368 is fully inserted into the housing 362, the plunger 368 contacts the captured balls 372 to urge them outwardly and prevent them from moving inwardly to thereby lock the connector 128 within the receptacle 300. When the pull tab 376 is pulled in the axial direction to retract the plunger 368 so that the plunger 368 disengage with the ball members 372, the ball members 372 are free to move inwardly and disengage from the complementary recesses or depressions within the receptacle 300 to allow manual removal of the connector 128 from the receptacle 300. In embodiments, a captured spring or other resiliently compressible member 374 within the housing 362 bears against the plunger 368 for biasing the plunger into the locked position. In this manner, disengagement between the connector end 128 and the weapon mounted connector 132 is prevented unless the tab 376 is pulled with sufficient force to overcome the bias of the spring element 374, thereby reducing the chance of inadvertent disengagement of the connector end 128 from weapon mounted connector 132.

Figure 13:
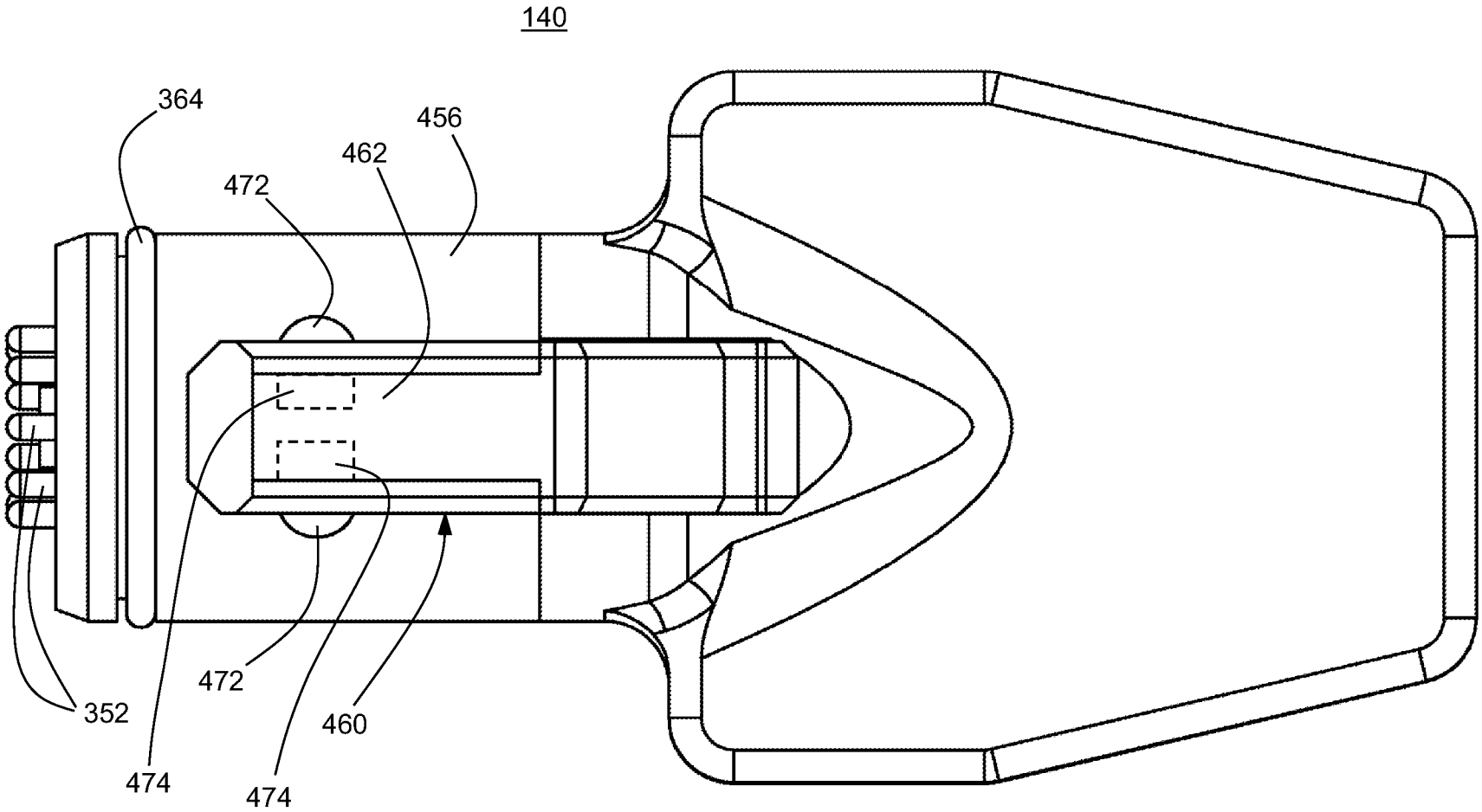
FIG. 13 is a side view of the weapon sling connector end for attaching to the associated plate carrier vest.
Figure 14:
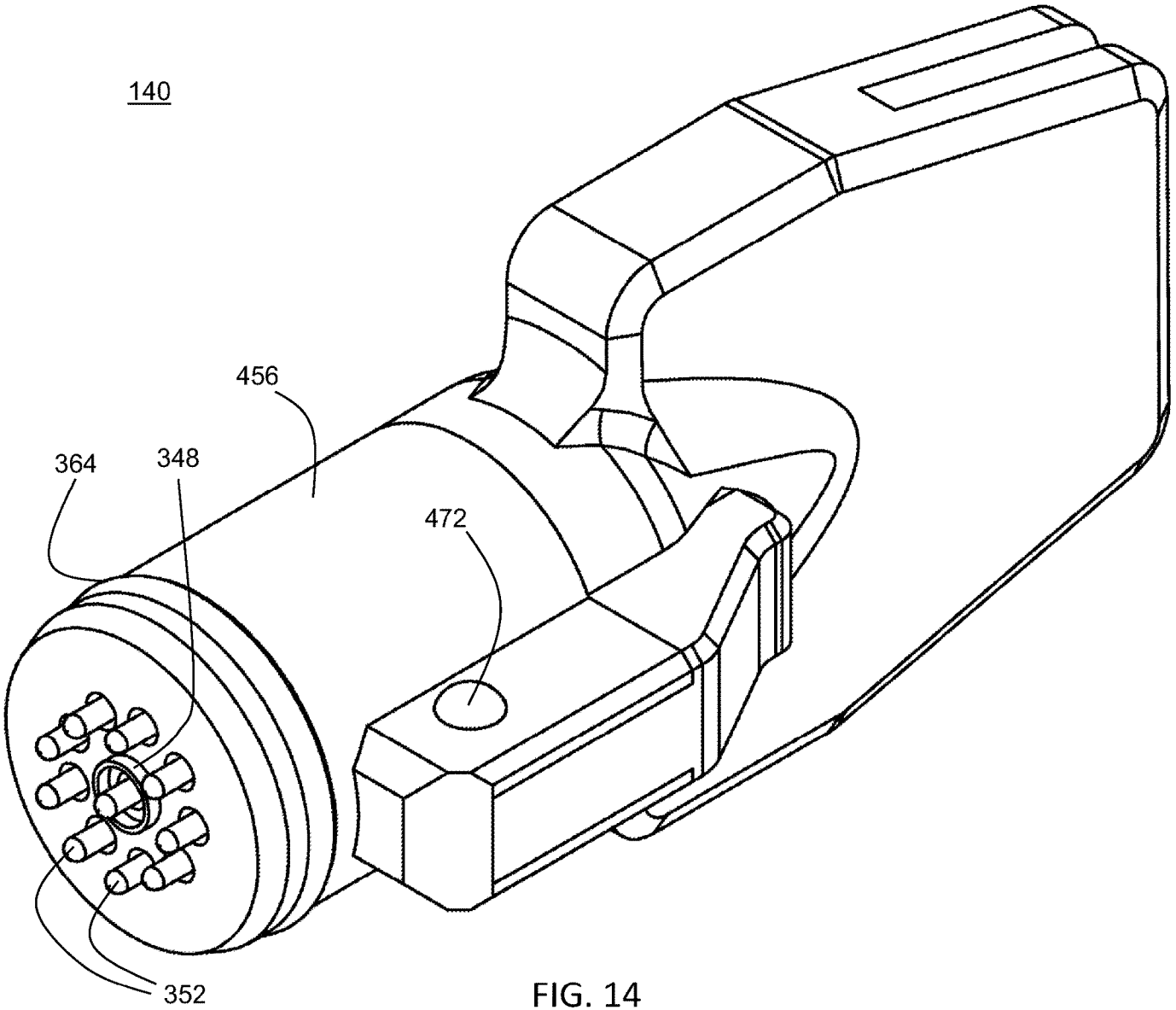
FIG. 14 is an isometric view of the weapon sling connector end appearing in FIG. 13.

Referring now to FIGS. 13 and 14, and with continued reference to FIGS. 1-12, the connector 116 includes a coaxial connector 348 which is electrically coupled to the coaxial cable 332. A plurality of connector pins 352 align with complementary connector terminals or pads disposed within a connector receptacle 434 on the hub connector assembly 120. Each connector pin 352 is electrically coupled to a corresponding conductor within the main branch 124, including the twisted pair conductor, power, and ground conductors. One or more of the pins 352 may also be coupled to a drain wire, metallic or conductive shield, e.g., for carrying unwanted electrical noise to ground. In embodiments, the connector pins 352 are spring-loaded telescoping (pogo) pins.

The connector assembly 116 includes a cylindrical body 456 with an axially extending projection 460. A sealing ring 364 prevents entry of moisture or other external contamination. The projection 460 aligns with a complementary axial channel in the receptacle 434 of the hub assembly 120 and provides a keyed configuration to ensure proper alignment of the connector 116 within the receptacle 434.

A resilient ball detent breakaway retention mechanism allows for positive retention of the connector 116 within the receptacle 434, wherein the connector 116 will disengage from the receptacle 434 upon application of a pulling force which overcomes the retention force of the resilient ball detent breakaway mechanism. The projection 460 defines a housing 462 enclosing an axially-extending channel which receives captured ball members 472 that extend through the projection housing 460. The ball members 472 are aligned with and engage complementary recesses or depressions within the receptacle 434 when the connector 116 is received within the receptacle 434. The ball members 472 are resiliently biased in the outward direction by one or more captured resiliently compressible members 474, such as a coil spring or other resiliently compressible material.

Manually pulling the connector end 116 with sufficient force to compress the compressible/spring member(s) 474 allows causes the ball members 472 to disengage from the complementary receptacles within the receptacle 434 against the urging to the spring member(s) 474 to allow withdrawal of the connector end 116 from the receptacle 434. In embodiments, as best seen in FIG. 9, a like breakaway mechanism is provided on the connector 128.

Figure 15:
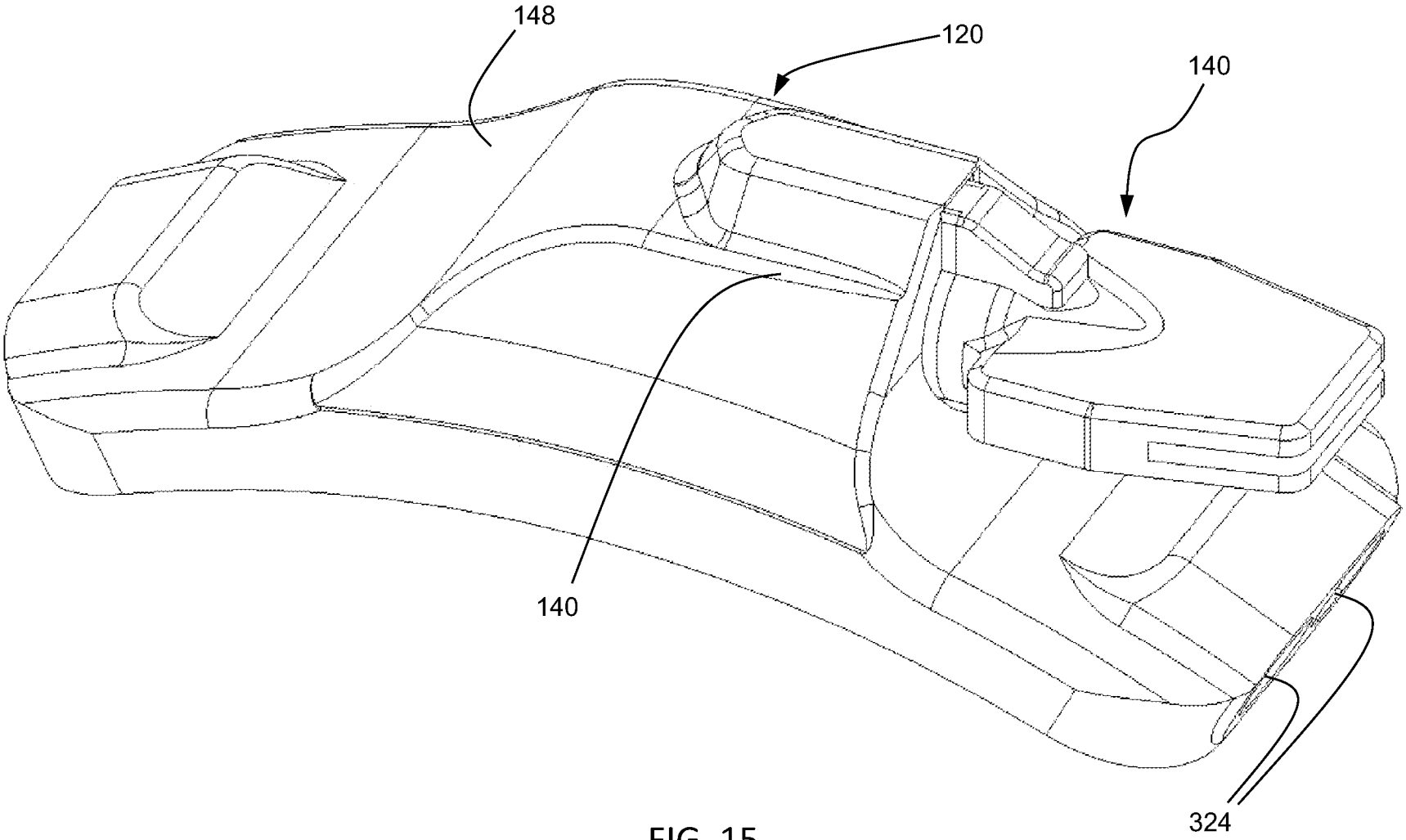
FIG. 15 is an isometric view of the connector portion of the plate carrier vest with the weapon sling connector end inserted.
Figure 16:
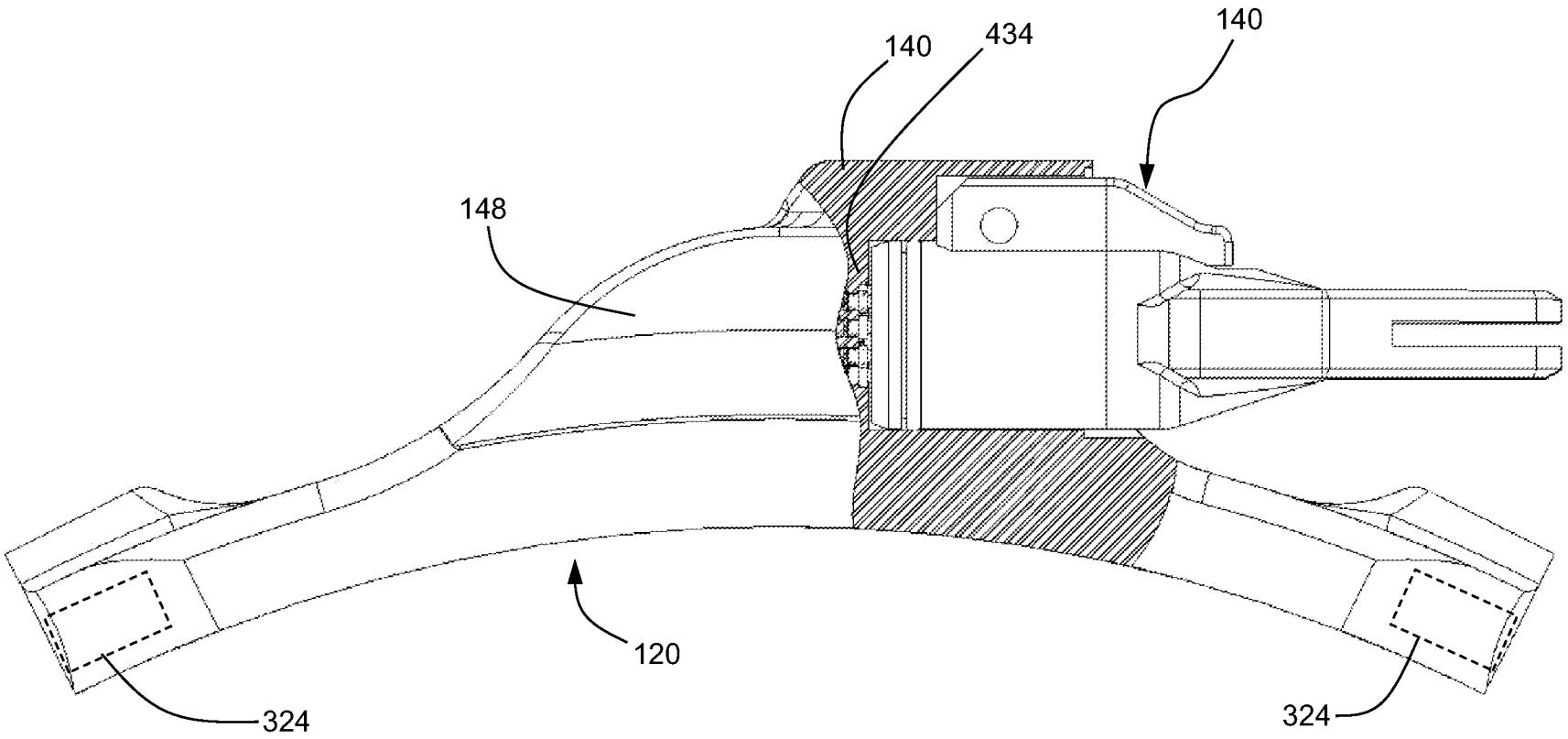
FIG. 16 is a side partial cutaway view of the connector portion of the plate carrier vest with the weapon sling connector end inserted.

Referring now to FIGS. 15 and 16, and with continued reference to FIGS. 1-14, the hub 120 is operatively coupled to the host computer system 320 via the main branch portion 124 of the sling assembly 100. The hub housing 148 further includes a plurality of connection ports 324 for coupling a plurality of electronically operated devices to the host computer system 320. In certain embodiments, the hub 120 includes four connection ports 324. In certain embodiments, the connection ports are USB Type-C connection ports. In certain embodiments, the connection ports 324 are locking USB Type-C connection ports as shown and described in the aforementioned U.S. Patent Application No. 63/423,324 and Ser. No. 18/381,937. In embodiments, the hub 120 is configured to be operatively coupled to a helmet mounding assembly, such as the helmet mounting assembly shown and described in commonly-owned U.S. Provisional Patent Application No. 63/427,496 filed Nov. 23, 2022, entitled "Helmet System," and U.S. patent application Ser. No. 18/500,657 filed Nov. 2, 2023, entitled "Helmet Accessory System," wherein the entire contents of each of the aforementioned applications, including the drawings, are incorporated herein by reference in their entireties.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims and their legal equivalents.

What is claimed is:

1. A weapon sling for supporting a weapon, comprising:

a strap member having a first free end and a second free end opposite the first free end and defining a main branch extending between the first free end and the second free end, the strap member being formed of an elongate hollow flexible element;

a loop branch attached to the main branch, the loop branch configured to be looped around at least a portion of a body of a user;

a first connector assembly secured to the first free end and a second connector assembly secured to the second free end;

the first connector assembly configured for detachable coupling to a weapon connector disposed on the weapon;

the second connector assembly configured for detachable coupling to a hub connector disposed on a hub worn on the body of the user;

a plurality of electrical conductors extending within the elongate hollow flexible element for electrically coupling a plurality of electrical contacts on the first connector assembly with a corresponding plurality of electrical contacts on the second connector assembly, the plurality of electrical conductors for providing communications between a host computer on the weapon and the hub.

2. The weapon sling of claim 1, wherein the loop branch has a first fixed end attached to the main branch proximal the first free end of the main branch, and wherein the loop branch has a second fixed end attached to the main branch proximal the second free end of the main branch.

3. The weapon sling of claim 1, wherein the loop branch has a first fixed end attached to the main branch proximal the first free end of the main branch, and wherein the loop branch has a third free end configured to be detachably coupled to the weapon.

4. The weapon sling of claim 1, wherein the first connector assembly includes a locking mechanism configured to provide a locking engagement between the first connector assembly and the weapon connector.

5. The weapon sling of claim 1, wherein the first connector assembly includes a breakaway mechanism configured to disengage the first connector assembly from the weapon connector when a pulling force on the first connector assembly exceeds a preselected threshold.

6. The weapon sling of claim 5, wherein the breakaway mechanism comprises:

at least one ball detent captured within a receptacle on the first connector assembly, the at least one ball detent configured to mate with at least one recess within the weapon connector.

7. The weapon sling of claim 1, wherein the second connector assembly includes a breakaway mechanism configured to disengage the second connector assembly from the hub connector when a pulling force on the second connector assembly exceeds a preselected threshold.

8. The weapon sling of claim 7, wherein the breakaway mechanism comprises:

at least one ball detent captured within a receptacle on the second connector assembly, the at least one ball detent configured to mate with at least one recess within the hub connector.

9. The weapon sling of claim 1, wherein the strap member is formed of an elongate hollow textile element.

10. The weapon sling of claim 9, wherein at least a portion of the elongate hollow textile element is stretchable.

11. The weapon sling of claim 10, wherein at least a portion of the plurality of electrical conductors is folded back on itself for accommodating stretching while maintaining an electrical connection.

12. The weapon sling of claim 1, wherein at least a portion of the elongate hollow flexible element is formed of a nylon webbing material.

13. The weapon sling of claim 1, wherein the second connector assembly comprises a Universal Serial Bus (USB) connector.

14. The weapon sling of claim 1, in combination with said hub.

15. The weapon sling of claim 14, wherein the hub comprises a housing adapted to be attached to be a garment.

16. The weapon sling of claim 15, wherein the hub comprises a sleeve attached to the housing, wherein the sleeve is adapted to be adapted to be attached to be the garment.

17. The weapon sling of claim 16, wherein the sleeve is configured to be detachably attached to a shoulder strap of the garment.

18. The weapon sling of claim 17, wherein the sleeve is configured to be selectively attached to a left shoulder strap and a right shoulder strap of the garment.

19. The weapon sling of claim 17, wherein the garment is a vest selected from the group consisting of a plate carrier vest, tactical vest, load bearing or load carrying vest.

* * * * *